US007013624B2

(12) United States Patent
Zwilling

(10) Patent No.: US 7,013,624 B2
(45) Date of Patent: Mar. 21, 2006

(54) BEVERAGE BOTTLING PLANT FOR FILLING BOTTLES WITH A LIQUID BEVERAGE FILLING MATERIAL, A CONTAINER FILLING PLANT CONTAINER INFORMATION ADDING STATION, SUCH AS, A LABELING STATION, CONFIGURED TO ADD INFORMATION TO CONTAINERS, SUCH AS, BOTTLES AND CANS, AND MODULES FOR LABELING STATIONS

(75) Inventor: Heinz-Michael Zwilling, Hamm (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

(21) Appl. No.: 10/780,280

(22) Filed: Feb. 17, 2004

(65) Prior Publication Data

US 2004/0221546 A1 Nov. 11, 2004

(30) Foreign Application Priority Data

Feb. 18, 2003 (DE) ..... P 103 06 671

(51) Int. Cl.
*B65B 35/56* (2006.01)

(52) U.S. Cl. ..... 53/544; 53/493; 53/498; 53/500; 53/131.4; 53/135.1; 53/284.6; 53/266.1; 53/53

(58) Field of Classification Search ..... 53/52, 53/446, 493, 498, 500, 467, 478, 131.3, 135.1, 53/473, 136.1, 266.1, 284.5, 284.6
See application file for complete search history.

(56) References Cited

U.S. PATENT DOCUMENTS

| | | | | |
|---|---|---|---|---|
| 3,527,334 | A * | 9/1970 | Wideman | 198/379 |
| 4,428,474 | A * | 1/1984 | Gau et al. | 198/394 |
| 5,224,586 | A * | 7/1993 | Naka et al. | 198/803.11 |
| 5,771,657 | A * | 6/1998 | Lasher et al. | 53/55 |
| 6,484,478 | B1 * | 11/2002 | Arends et al. | 53/544 |
| 6,494,238 | B1 * | 12/2002 | Sindermann | 141/6 |
| 6,522,945 | B1 * | 2/2003 | Sleep et al. | 700/225 |
| 6,868,652 | B1 * | 3/2005 | Arends et al. | 53/446 |

* cited by examiner

*Primary Examiner*—John Sipos
*Assistant Examiner*—Christopher Harmon
(74) *Attorney, Agent, or Firm*—Nils H. Ljungman & Associates

(57) ABSTRACT

A beverage bottling plant for filling bottles with a liquid beverage filling material, a container filling plant container information adding station, such as, a labeling station, configured to add information to containers, such as, bottles and cans, and modules for labeling stations proposed a labeling machine. Each module comprises a first coupling structure to permit interchangeable position of a module at one of a plurality of second coupling structures. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, the abstract is not intended to limit the claims in any manner and should not be interpreted as limiting the claims in any manner.

3 Claims, 5 Drawing Sheets

BEVERAGE BOTTLING PLANT FOR FILLING BOTTLES WITH A LIQUID BEVERAGE FILLING MATERIAL, A CONTAINER FILLING PLANT CONTAINER INFORMATION ADDING STATION, SUCH AS, A LABELING STATION, CONFIGURED TO ADD INFORMATION TO CONTAINERS, SUCH AS, BOTTLES AND CANS, AND MODULES FOR LABELING STATIONS

BACKGROUND

1. Technical Field

The present application in one aspect relates to a beverage bottling plant for filling bottles with a liquid beverage filling material, a container filling plant container information adding station, such as a labeling station, configured to add information to containers, such as bottles and cans, and modules for labeling stations.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus being configured to introduce a predetermined volume of liquid beverage filling material into the interior of bottles to a substantially predetermined level of liquid beverage filling material, and the apparatus configured to introduce a predetermined flow of liquid beverage filling material comprising apparatus being configured to terminate the filling of beverage bottles upon liquid beverage filling material reaching said substantially predetermined level in bottles. There may also be provided a conveyer arrangement being configured and disposed to move bottles, for example, from an inspecting machine to the filling machine. Upon filling, a closing station closes filled bottles. There may further be provided a conveyer arrangement configured to transfer filled bottles from the filling machine to the closing station; as well as a loading station that is configured to load filled bottles into containers, for example, in a six-pack arrangement. There may also be provided a conveyor arrangement configured to transfer filled bottles from the closing station to the loading station.

In the packaging of wares of diverse sorts, such as, for example, beverages or items of food, it has been found highly advantageous to configure the containers in which such wares are offered as advantageously and appealingly as possible. Aside from configuration of the body of containers, the container labeling, that is ever increasing in display, also plays an increasingly important role.

When at one labeling machine several different container types are to be labeled, as is now customarily always the case, or, respectively, several diverse label sets need to be processed, down times of significant duration arise due to necessary refitting efforts. This is particularly the case in the event that containers need to be furnished with several labels at the front side and at the rear side.

In order so as to provide solutions to this problem, inter alia, in German Patent No. DE 199 53 255, in U.S. Pat. No. 4,362,594, and in German Patent No. DE 197 41 476, designs are presented that allow the exchange in full of the labeling stations that are arranged at a labeling machine, so that the down times can be markedly reduced, because the required conversion work that is required to be performed at a labeling station can be accomplished at a separate work location and as such essentially at the same time, that is, without shut-down of the labeling machine.

German Patent No. DE 199 53 255, U.S. Pat. No. 4,362,594, and German Patent No. DE 197 41 476 are hereby incorporated by reference as if set forth in their entirety herein.

Although the above-cited designs in the field of labeling technology have achieved a considerable advance in the art, there is not satisfactorily achieved, by the above-cited designs, quick and economic adaptation of labeling machines to labeling requirements that significantly deviate from one another.

Thus, customarily, often the task arises, for example, to precisely align containers having an embossed logo, or cliplock bottles, prior to labeling. In this it is state of the art that functional units that perform this task are fixedly and permanently arranged at the labeling machine, which substantially permanently reduces the number of possible labeling stations, such that one has also not available these labeling stations in the case of processing containers that need not be aligned.

Similar considerations apply with functional units that control, for example, the presence or the correct position of labels. Again, these functional units, in accordance with the state of the art, are fixedly and permanently arranged at the labeling machines, such that the disadvantages enumerated above are also applicable in these situations.

OBJECTS

One object of an embodiment described below is to solve the problems encountered on similar apparatus of the prior art.

It is also an object to accomplish remedy and improvement, such that the labeling machines can be rapidly and economically adapted to a variety of labeling tasks.

SUMMARY

There is provided a beverage bottling plant for filling bottles with a liquid beverage filling material, said beverage bottling plant comprising: a filling machine being configured to fill empty bottles with liquid beverage filling material; a conveyer arrangement being configured and disposed to move empty bottles to said filling machine; said beverage filling machine comprising a plurality of beverage filling positions, each beverage filling position comprising a beverage filling device for filling bottles with liquid beverage filling material; said filling devices comprising an apparatus being configured to introduce a predetermined volume of liquid beverage filling material into the interior of bottles to a substantially predetermined level of liquid beverage filling material; said apparatus being configured to introduce a predetermined volume of liquid beverage filling material comprising an apparatus being configured to terminate the filling of beverage bottles upon liquid beverage filling material reaching said substantially predetermined level in bottles; a closing station being configured and disposed to close filled bottles; a conveyer arrangement being configured and disposed to transfer filled bottles from said filling machine to said closing station; a labeling station being configured and disposed to receive bottles to be labeled; a conveyer arrangement being configured and disposed to convey bottles to said labeling station; said labeling station comprising: a frame structure, said frame structure having an axis disposed vertically; a turntable structure being configured and disposed to rotate about said vertical axis of said frame structure, said turntable structure having a peripheral region; a drive arrangement being configured and disposed to rotate said turntable structure about said vertical axis of said frame structure; a plurality of support tables being configured to support and to rotate a bottle; said support tables being disposed at said peripheral region of said turntable structure; each support table having an axis disposed vertically about which vertical axis a support table can rotate; each support table comprising a drive arrangement being configured and disposed to rotate its corresponding support table about its vertical support table axis, to permit rotation of a bottle supported on a support table; a plurality of modules comprising: a first module comprising: at least one camera being configured and disposed to produce an image representative of the actual rotational position of a bottle supported on its corresponding support table adjacent said first module and to output signals representative of the image representative of the actual rotational position of a bottle; a computer being configured and disposed to receive from said camera the output signals representative of the actual rotational position of a bottle, to compare the image representative of the actual rotational position with an image representative of a preset rotational position, and to output signals, to the drive arrangement of an adjacent support table, to energize the drive arrangement and thus to rotate to a first position said adjacent support table and a supported bottle; a second module comprising: at least one camera being configured and disposed to produce an image representative of the actual rotational position of a bottle supported on its corresponding support table adjacent said second module and to output signals representative of the image representative of the actual rotational position of a bottle; a computer being configured and disposed to receive from said camera of said second module the output signals representative of the actual rotational position of a bottle, to compare the image representative of the actual rotational position with an image representative of a preset rotational position, and to output signals, to the drive arrangement of said support table adjacent said second module, to energize the drive arrangement and thus to rotate to a second position said support table adjacent said second module and a supported bottle; said second position being of greater precision than said first position; a third module being configured and disposed to affix a label to a bottle disposed in said second position on a support table adjacent said third module; a fourth module being configured and disposed to print information on the label affixed to a bottle by said third, labeling, module; and a fifth module being configured and disposed to inspect for the presence of a label on a bottle, and to determine the position of a label on a bottle; each of said modules comprising a first coupling structure; a plurality of second coupling structures, each being connected to said frame structure; each first coupling structure being configured to be connectable to and to be disconnectable from its corresponding second coupling structure; and each module being configured, upon connection to a second coupling structure, to be disposed adjacent moving bottles supported on said support tables.

There is further provided a container filling plant labeling station configured to label containers, such as, bottles and cans, said labeling station comprising: a frame structure, said frame structure having an axis disposed vertically; a turntable structure being configured and disposed to rotate about said vertical axis of said frame structure, said turntable structure having a peripheral region; a drive arrangement being configured and disposed to rotate said turntable structure about said vertical axis of said frame structure; a plurality of support tables, connected to said peripheral region of said turntable structure and each being configured and disposed to support a container and to rotate a supported container; each support table comprising a drive arrangement being configured and disposed to rotate its corresponding support table, to permit rotation of a container supported on a support table; a plurality of modules at least comprising: a first module comprising: at least one sensor being configured and disposed to produce a representation of the actual position of a container supported on its corresponding support table adjacent said first module and to output signals representative of the representation of the actual position of a container; a computer being configured and disposed to receive from said sensor the output signals representative of the representation of the actual position of a container, to compare the representation of the actual position with a representation of a preset position, and to output signals, to the drive arrangement of an adjacent support table, to energize the drive arrangement and thus to rotate to a preset position said adjacent support table and a supported container; a second module being configured and disposed to affix a label to a container disposed in said preset position on an adjacent support table; a third module being configured and disposed to inspect for the presence of a label on a container, and to determine the position of an affixed label on a container; each of said modules comprising a first coupling structure; a plurality of second coupling structures, each being connected to said frame structure; each first coupling structure being configured to be connectable to and to be disconnectable from its corresponding second coupling structure; and each module being configured, upon connection to a second coupling structure, to be disposed adjacent moving containers supported on said support tables.

There is yet further provided a container filling plant container information adding station, such as, a labeling station, configured to add information to containers, such as, bottles and cans, said information adding station comprising: a plurality of supports, each being configured and disposed to support a container thereon; each support comprising an arrangement being configured and disposed to adjust its corresponding support, to permit adjustment of the position of a container supported on said corresponding support; a first module comprising a first sensor being configured and disposed to output signals representative of the actual position of a container disposed on a predetermined support which predetermined support is disposed in a predetermined position with respect to said first module; an arrangement being configured and disposed: to receive output signals representative of the actual position of a container disposed in a predetermined position with respect to said first module from said first sensor, to compare the representation of the actual position with a stored representation of a desired position of a container, to output signals to the adjusting arrangement of said predetermined support to move said predetermined support and the container supported thereon to the desired position; at least one second module being configured to add information to a container disposed in the desired position on said predetermined support; each module comprising a first coupling structure; said container information adding station comprising at least one second coupling structure; each said at least one second coupling structure being configured and disposed to receive output signals related to said first sensor to adjust said predetermined support and the container supported thereon; each first coupling structure being configured to be connectable to and to be disconnectable from its corresponding second coupling structure; each module being configured, upon connection to a second coupling structure, to be disposed in a predetermined location with respect to moving containers supported on said supports.

Thus, according to one aspect it is disclosed that the functional units, such as, for example, aligning, inspecting, or printing of containers are configured as interchangeable units that have a standard interface and, in accordance with a labeling task, can be mounted rapidly and simply at different positions of a labeling machine or station. With this the above-mentioned modules can also be mounted in place of the actual labeling stations.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Embodiments are further described in greater detail with reference to the accompanying drawings.

DESCRIPTION OF EMBODIMENTS

Figure 1:
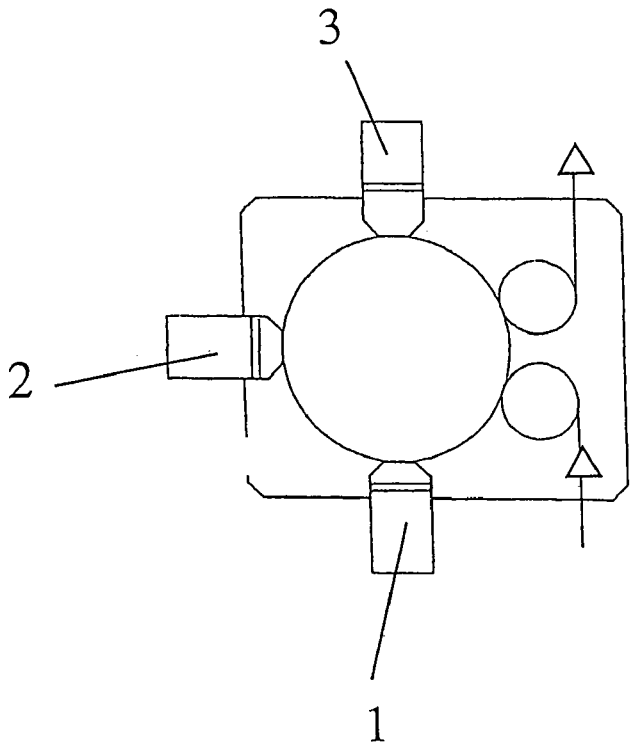
FIG. 1 PRIOR ART
FIG. 1 shows in a simplified plan view a labeling machine in accordance with the prior art.
Figure 1A:
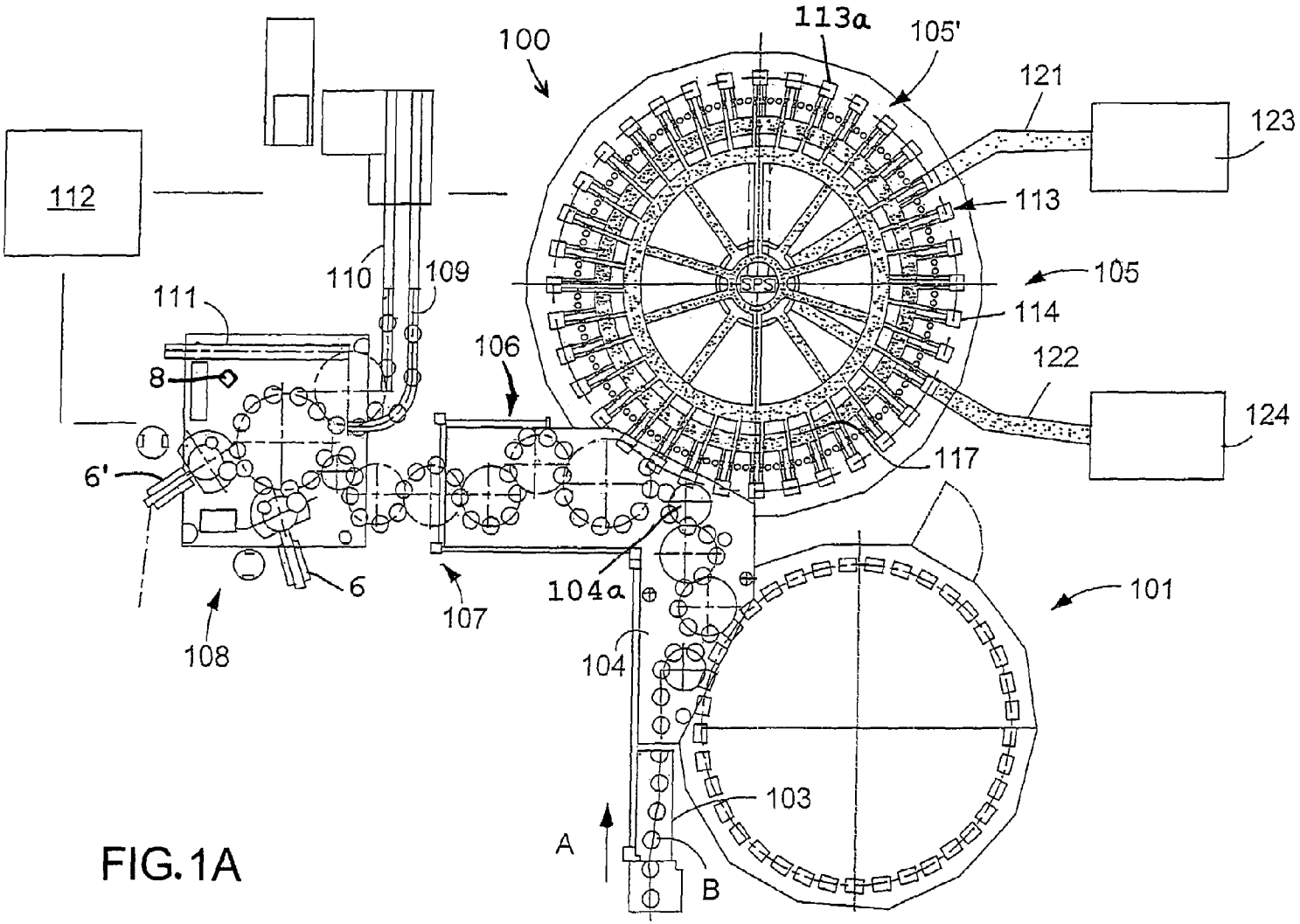
FIG. 1A is a schematic illustration of a container filling plant in accordance with one possible embodiment.

FIG. 1A shows schematically the main components of one embodiment example of a system for filling containers, specifically, an embodiment of a beverage bottling plant 100 for filling bottles B with liquid beverage filling material, in accordance with one embodiment, or in which system or plant could possibly be utilized at least one aspect, or several an aspects, of the embodiments disclosed herein.

FIG. 1A shows a rinser or rinser station 101, to which the containers, namely bottles B, are fed in the direction of travel as is indicated by the arrow A, by means of a conveyer line or conveyer arrangement 103, and downstream of rinser station 101, in the direction of travel as is indicated by the arrow A, the rinsed bottles B are transported to a beverage filling machine 105 by means of a conveyer line or conveyer arrangement 104 that is formed, for example, by a star wheel conveyer or a plurality of star wheels of a conveyer arrangement. The conveyer arrangement 104 may possibly have a star wheel 104*a* that introduces bottles B to the filling machine 105.

Downstream of the filling machine 105, in the direction of travel of the bottles B, there can preferably be a closer or closer station 106 which closes the bottles B.

The closer or closer station 106 can, for example, be connected directly to a labeling device or labeling station 108, such as, for example, by means of a conveyer line or conveyer arrangement 107 that may be formed, for example, by a plurality of star wheels of a conveyer arrangement.

In the illustrated embodiment, the labeling device or labeling machine or labeling station 108 has, for example, three outputs, namely one output formed by a conveyer or conveyer arrangement 109 for bottles B that are filled with a first product. The first product may possibly be provided by a product mixer 123 that is connected to the filling machine 105, for example, through a conduit 121, and bottles B that are filled with a predetermined volume of liquid beverage filling material, that is, the first product, are then labeled by a labeling module 6 in the labeling stations 108 corresponding to this first product delivered from product mixer 123 to the beverage filling machine 105 and thence to the corresponding bottles B. One embodiment of a labeling station, or labeling machine, is described in greater detail herein below with reference to FIG. 1.

A second output that is formed by a conveyer or conveyer arrangement 110 is provided for those bottles B that are filled with a second product. The second product may emanate from a second product mixer 124 that is connected, for example, through a conduit 122 to the filling machine 105, and these bottles B filled with a predetermined volume of liquid beverage filling material comprising the second product are then correspondingly labeled by a labeling module 6' in the labeling station 108 corresponding to this second product.

A third output, for example, formed by a conveyer or conveyer arrangement 111, removes any bottles B which have been incorrectly labeled as may have been determined by an inspecting device or an inspecting station, or an inspecting module 8 that may possibly form a part of the labeling station 108.

In FIG. 1A item 112 is a central control unit or, expressed differently, a controller or a system which includes a process controller that, among other things, controls the operation of the above-referenced system or plant.

The beverage filling machine 105 is preferably of the revolving design, with a rotor 105', which revolves around a vertical machine axis. On the periphery of the rotor 105' there are a number of filling positions 113, each of which comprises bottle carriers or container carriers 113*a* that are configured and disposed to present bottles B for filling, as well as a filling device or element or apparatus 114 located or configured to be located above the corresponding container carrier 113*a* and the corresponding bottle B presented by the carrier 113*a*. The filling device or apparatus 114 comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, filling elements 114 are configured and disposed to provide a predetermined flow of liquid beverage filling material from the source thereof, such as, product mixers 123 and 124, into the bottles B.

The toroidal vessel 117 is a component, for example, of the revolving rotor 105'. The toroidal vessel 117 can be connected by means of a rotary coupling or a coupling that permits rotation, and by means of an external connecting line 121 to the external reservoir or product mixer 123 to supply the product, that is, product mix 1, for example.

As well as the more typical filling machines having one toroidal vessel, it is possible that in at least one possible embodiment a filling machine could possibly be utilized wherein each filling device 114 is preferably connected by means of two connections to a toroidal vessel 117 which contains a first product, say by means of a first connection, for example, 121, and to a second toroidal vessel which contains a second product, say by means of the second connection, for example, 122. In this case, each filling device 114 can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

FIG. 1 shows in a simplified plan view of a labeling machine or station or arrangement in accordance with the state of the art with three distributed label-affixing stations or labeling modules 1, 2, and 3.

Figure 2:
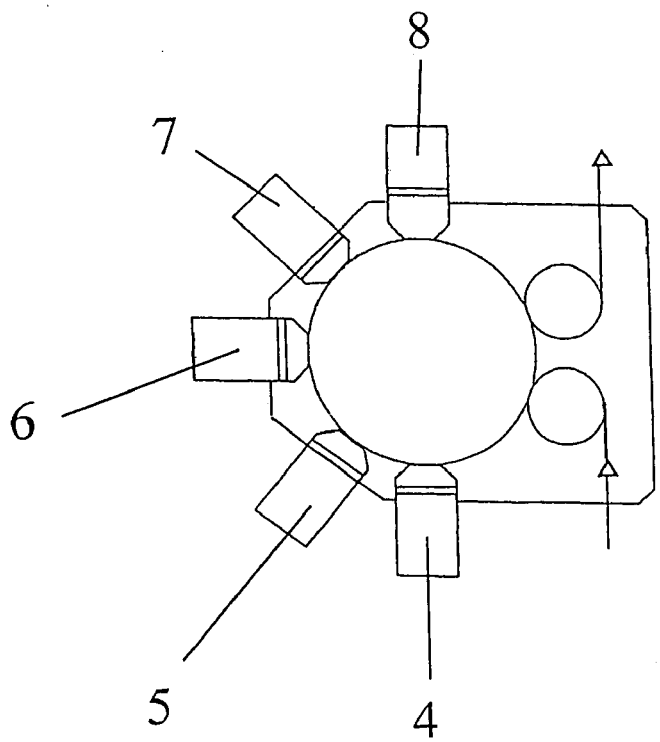
FIG. 2 shows in a simplified plan view a labeling machine or station in accordance with one possible embodiment.

There is shown in FIG. 2 in a simplified plan view of a labeling machine or station that comprises two alignment modules 4 and 5, a labeling module 6, a printing module 7, and an inspecting module 8.

Further development details, advantages and possibilities of application of the invention can be obtained from the following description of embodiments and the drawing. With this, all described and/or illustrated features per se or in any combination, comprise the substance of the invention, regardless of their combination in the claims or their dependency. At the same time, the content of the claims is made a component of the description.

So as to be able to adapt labeling machines more rapidly and with greater flexibility to changing labeling tasks, the present application suggests in one aspect that the necessary mechanical and/or electronic groups are combined in functional groups or modules that can be connected, by way of a standard interface at various positions of a labeling machine.

First an 'alignment' module is described.

For the case that the container is to be aligned prior to labeling, there is available that labeling machines are used that have support tables that are individually driven so as to rotate by its own servo-motor or stepping motor. This is often the case with modern labeling machines, because the provision of support tables that are driven by servo-motors or stepping motors, alone already for the realization of the rotational movements of containers per se that are necessary for the labeling of the containers, is highly advantageous.

When support tables are available that are driven for rotation by servo-motors or stepping motors, alignment of the containers can be realized in a simple and economical manner, because all the essential groups are already present.

For an alignment module, the present application provides in one aspect that the module comprises at least one camera and as a matter of contingency an arrangement to provide light. In a further, particularly advantageous embodiment of the present application, it is provided additionally to arrange, within a module, an evaluating computer that evaluates images produced by the at least one camera, that determines the necessary correction of the rotational position of the support table, and that transmits this correction, via the machine control of the labeling machine, to the support tables.

In a further embodiment of the present application, it is provided to transmit the necessary correction of the rotational position directly, that is, by bypassing the machine control, to the support tables. This operation considerably simplifies the program logic and the course of machine control and only a marginal expense is added. In order to realize this function, at least one sensor is associated with each support table. This sensor is disposed in the vicinity of the support table, that is, at the outer circumference of the turntable. At least one signal source is arranged within the alignment module. In the event that the alignment module now recognizes the requirement for a correction of the rotational position, the necessary information is directly passed, via the signal source and sensor, to the servo-motor or stepping motor, or, respectively, their control of the affected support table, such that this can perform the necessary rotational movements. The signal source and sensor may be, for example, a combination of an infrared transmitter and a receiver, such that by first impulses the direction of rotation and by following impulses the magnitude of the correction of rotational position that needs to be accomplished, is transmitted.

In this it is of particular advantage that the signal source extends along a certain portion of the arc prescribed by the sensor because in this manner compensation can be provided for the rotation of the turntable.

It is also provided to utilize two of more alignment modules. This arrangement can then be of particular advantage when an alignment of the containers is to be done particularly precisely and needs to be done in a rough alignment and also a fine alignment.

In particular applications use of mechanically, optically, capacitively, or inductively operating sensors or other sensors that operate under another method known in the state of the art, may be advantageous for the determination of the actual alignment of a container, with the sensor in such applications being a part of the exchangeable module.

Aside from the above-described 'alignment' module, utilization of an 'inspecting' module is contemplated in accordance with one aspect of the application.

The function of the 'inspecting' module comprises, for example, the checking of the labeling result. This can be an inspection that merely inquires whether a label is present, or it may comprise an expanded inquiry that additionally examines the proper position of the labels. For realization of this function there is also provided use of at least one camera and/or other sensors, with the operation of the sensors encompassing all methods known in the state of the art.

A particularly advantageous development of the inspecting module comprises that an evaluation computer is part of the module.

In a further development of the inspecting module there is provided that the data that are determined within the inspecting module, with respect to the position of the labels, can be utilized to correct the labeling. This includes, for example, automatic corrections of the rotational position of the support tables prior to or during the labeling per se, or also an automatic stop of the machine in the event that the labels on the containers are exceeding predetermined tolerance limits.

As well, embodiments of the inspecting module are contemplated that remove the incorrectly labeled container from further production processing.

Aside from utilization of the many solutions that have hitherto become known in the state of the art for the removal of the containers, that can also be used, it is contemplated to furnish the inspecting module per se with a removal arrangement. For example, this can be a vacuum-operated starwheel disposed on the inspecting module, that partially takes the responsibility of guiding bottles and accepts and removes defective containers.

In addition to the above-described modules, the present application also proposes a printing module. This printing module can contain components that achieve all printing methods known in the art. Such printing methods can be, for example, laser printing/laser marking, ink jet, tampon printing or sieve printing. This printing module can be employed, for example, for lettering of containers with a date of minimum stability of shelf-life, or it can be employed in the direct printing on containers or labels.

With respect to the standard interface, in accordance with one aspect, the present application proposes that aside from a mechanical connection that affords a connection free of play and that ensures precise positioning of the module at the labeling machine also electrical interfaces are provided for the transfer of drive/operating energy and control signals. Designs of connections free of play and that ensure precise positioning, as well as interfaces for the transfer of drive/operating energy are generally known in the state of the art, so that at this point a detailed description can be waived.

For the transmission of control signals, inter alia, bus-systems are at hand by means of which, for example, all relevant information, such as, for example, actual position, set or required angle of rotation and actual angle of rotation, set or required rotational velocity and actual rotational velocity are transferred between the machine control, to the control computers arranged on the individual modules, and all participating machine components.

Figure 3:
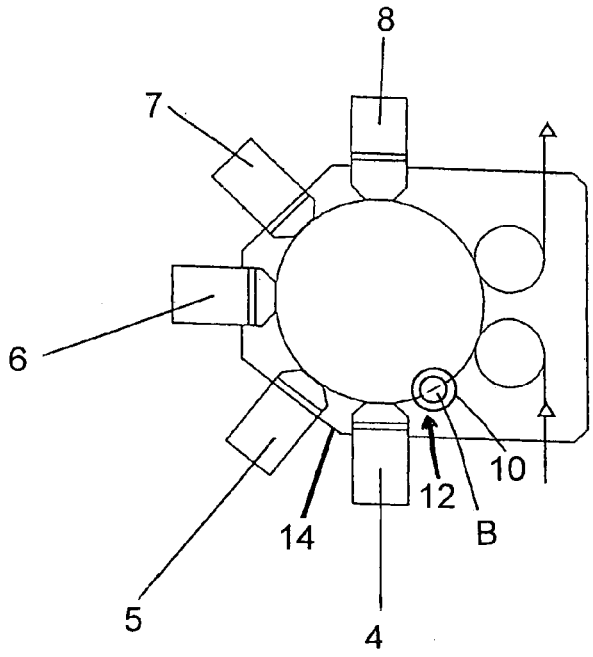
FIG. 3 shows a simplified plan view of a labeling station similar to FIG. 2 with additional detail in accordance with one possible embodiment.

Referring to FIG. 3, there is illustrated a labeling station with two alignment modules 4 and 5, a labeling module 6, a printing module 7, and an inspecting module 8. The modules are connectable to frame structure 14 of the labeling station. Containers, such as, for example, bottles B, are disposed on support tables 10 that each comprise an arrangement 12 configured to adjust the position of the corresponding support table 10, for example, to adjust to a desired rotational position the support table 10 and, accordingly, the bottle B supported thereon.

Figure 4:
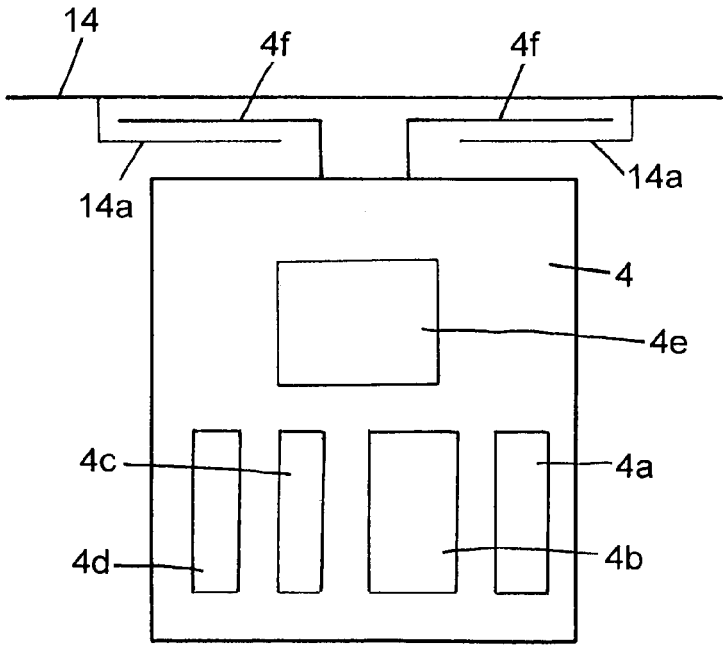
FIG. 4 is a schematic illustration of an alignment module that is configured to determine the position of a container.

FIG. 4 illustrates an alignment module 4 that comprises a sensor 4*a*, a camera 4*b*, an arrangement 4*c* configured to generate light, and a signal generating source 4*d*. The module 4 has a computer 4*e* that processes signals provided by the camera and/or the sensor 4*a* and the signal generating source 4*d*.

The alignment module 4 has two male flange portions 4*f* to secure module 4 to the frame structure 14 by means of two matching female receptor structures 14*a* that form part of the frame structure 14.

Figure 5:
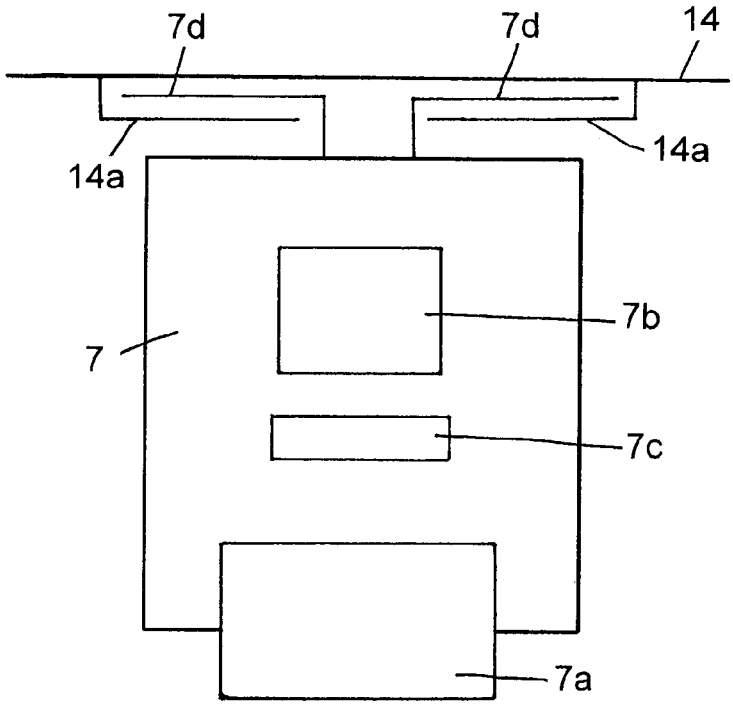
FIG. 5 is a schematic illustration of a module configured to print on a container or label of a container in accordance with one possible embodiment.

FIG. 5 illustrates a printing module 7 that comprises a print head 7*a* that is configured to print information on a bottle B, say, on the bottle B per se, or on a label affixed to bottle B. Printing module 7 has a computer 7*b* and sensor or sensors 7*c*.

Connection of printing module 7 to the frame structure is by way of male two male flange portions 7*d* configured to secure module 7 to the frame structure 14 by means of two matching female receptor structures 14*a* that form part of the frame structure 14.

Figure 6:
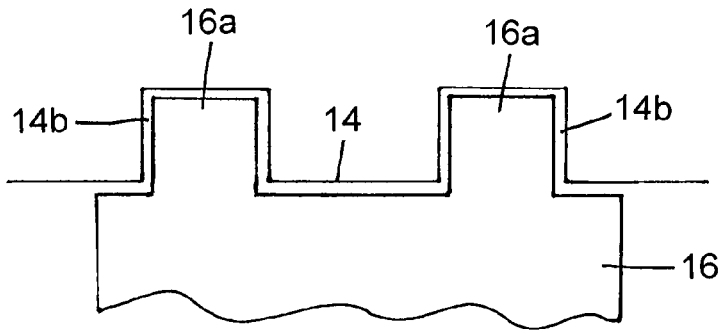
FIG. 6 is a schematic illustration of a further coupling structure arrangement to connect modules to the labeling station in accordance with one possible embodiment.

FIG. 6 illustrates a plug-in type of connection of a module, generally identified by reference numeral 16. Module 16 comprises plug-in portions 16*a* that can be connected to receptor portions 14*b* of the frame structure 14.

Figure 7:
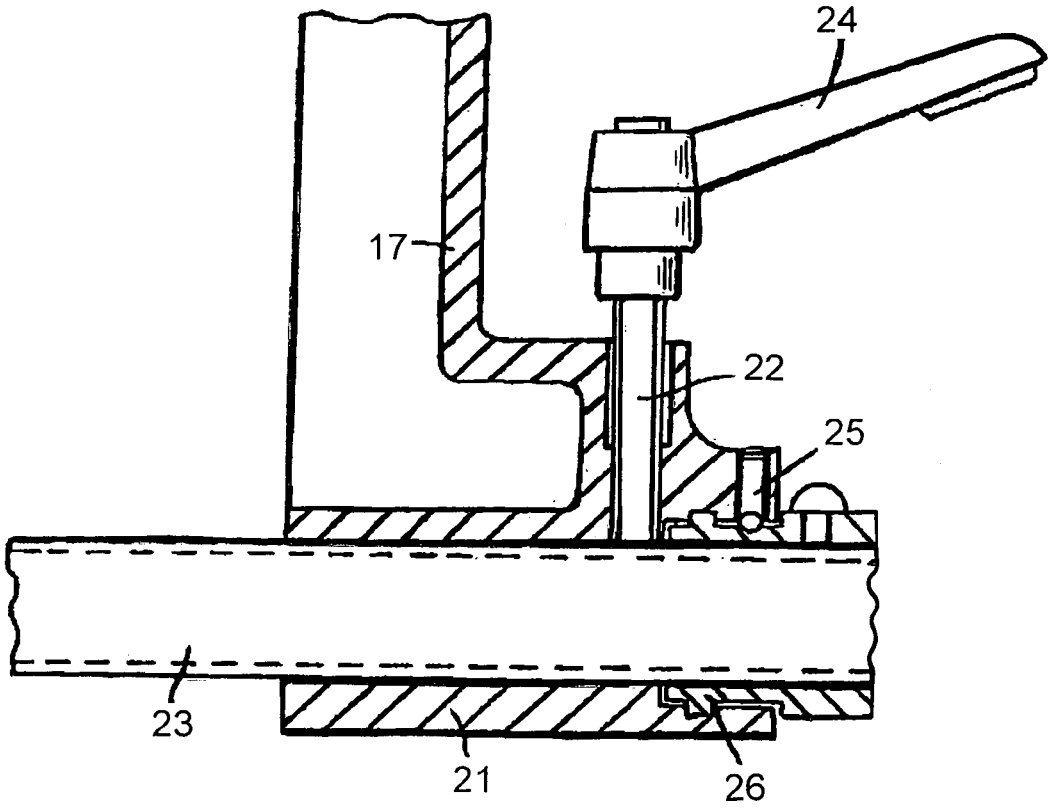
FIG. 7 is a side elevational view, partially in cross-section, of a connection to secure a module in accordance with one possible embodiment.

FIG. 7 illustrates one embodiment of a device to secure a plug-type connection. FIG. 7 shows a portion 17 of a frame structure that has a guide or receptor 21 that is configured to receive the plug end or portion 23 of a module. The portion 23 can be secured by a bolt member 22 that can be actuated by handle 24 so as to bear on or put pressure on portion 23. Additionally, the connection may be secured by a detent and recess arrangement 25 and a flange and groove arrangement 26. It will be appreciated that a plurality of portions 23 can be secured in like manner.

Thus, the application in one aspect relates to a labeling machine arrangement, particularly for containers and the like, comprising a machine frame structure with a drive for a turntable that is equipped with support tables for the items that are to be labeled, as well as processing stations connected to the machine frame structure, such as, for example, labeling stations or modules.

One feature or aspect of an embodiment is believed at the time of the filing of this patent application to possibly reside broadly in the labeling machine, particularly for containers and the like, comprising a machine frame structure with a drive for a turntable that is equipped with support tables for the items that are to be labeled, as well as processing stations connected to the machine frame structure, such as, for example, labeling stations, characterized in that next to the labeling stations are disposed at least one inspecting module and/or a printing module and/or an alignment module, and that this module is configured as a replaceable unit.

Another feature or aspect of an embodiment is believed at the time of the filing of this patent application to possibly reside broadly in the arrangement characterized in that the required mechanical and/or electronic components are combined into functional groups or modules.

Yet another feature or aspect of an embodiment is believed at the time of the filing of this patent application to possibly reside broadly in the arrangement characterized in that the modules can be mounted at different positions of a labeling machine by means of a standard interface.

Still another feature or aspect of an embodiment is believed at the time of the filing of this patent application to possibly reside broadly in the arrangement characterized in that the modules each have their own computer.

A feature or aspect of an embodiment is believed at the time of the filing of this patent application to possibly reside broadly in the arrangement characterized in that the modules have a bus-system for transfer of control information.

Another feature or aspect of an embodiment is believed at the time of the filing of this patent application to possibly reside broadly in the arrangement characterized in that the modules have an arrangement to provide light.

Yet another feature or aspect of an embodiment is believed at the time of the filing of this patent application to possibly reside broadly in the arrangement characterized in that the inspecting module comprises at least one camera.

Still another feature or aspect of an embodiment is believed at the time of the filing of this patent application to possibly reside broadly in the arrangement characterized in that the inspecting module has sensors that sense the labels.

A further feature or aspect of an embodiment is believed at the time of the filing of this patent application to possibly reside broadly in the arrangement characterized in that the inspecting module has sensors to sense the position of a label.

Another feature or aspect of an embodiment is believed at the time of the filing of this patent application to possibly reside broadly in the arrangement characterized in that the deviation of the actual position of the label from its required position is utilized to influence the labeling process.

Yet another feature or aspect of an embodiment is believed at the time of the filing of this patent application to possibly reside broadly in the arrangement characterized in that the deviation of the actual position of the label from its required position is utilized to disrupt the labeling process.

Still another feature or aspect of an embodiment is believed at the time of the filing of this patent application to possibly reside broadly in the arrangement characterized in that the inspecting module has a removal unit for incorrectly labeled containers.

A further feature or aspect of an embodiment is believed at the time of the filing of this patent application to possibly reside broadly in the arrangement characterized in that the alignment module has at least one camera.

Another feature or aspect of an embodiment is believed at the time of the filing of this patent application to possibly reside broadly in the arrangement characterized in that the alignment module has sensors that sense the degree of rotation of the containers.

Yet another feature or aspect of an embodiment is believed at the time of the filing of this patent application to possibly reside broadly in the arrangement characterized in that the alignment deviation that is determined by the alignment module can be utilized to correct, under utilization of the control of the machine, the degree of rotation of the support table that is rotatable about its vertical axis.

Still another feature or aspect of an embodiment is believed at the time of the filing of this patent application to possibly reside broadly in the arrangement characterized in that the alignment deviation that is determined by the alignment module can be utilized to correct, under avoidance of the control of the machine, the degree of rotation of the support table that is rotatable about its vertical axis.

A further feature or aspect of an embodiment is believed at the time of the filing of this patent application to possibly reside broadly in the arrangement characterized in that the printer module comprises at least one of the methods of: laser printing/laser marking, ink jet printing, tampon printing or sieve or screen printing.

Thus, in accordance with one aspect of the application there is proposed a labeling machine, particularly for containers and the like, comprising a machine frame structure with a drive for a turntable that is equipped with support tables for the items that are to be labeled, as well as processing stations connected to the sub-structure of the machine frame structure, such as, for example, labeling stations, there being provided that next to the labeling stations are disposed at least one inspecting module and/or a printing module and/or an alignment module, and that this module is configured as a replaceable unit.

Some examples of bottling systems that may possibly be utilized or possibly adapted for use in at least one possible embodiment of the present application may possibly be found in the following U.S. patents, all assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

The components disclosed in the various publications, disclosed or incorporated by reference herein, may possibly be used in possible embodiments of the present invention, as well as equivalents thereof.

Some examples of methods and apparatuses for closing bottles and containers and their components that may possibly be utilized or possibly adapted for use in at least one possible embodiment of the present may possibly be found in the following U.S. Pat. No. 5,398,485 issued to Osifchin on Mar. 21, 1995; U.S. Pat. No. 5,402,623 issued to Ahlers on Apr. 4, 1995; U.S. Pat. No. 5,419,094 issued to Vander Bush, Jr. et al. on May 30, 1995; U.S. Pat. No. 5,425,402 issued to Pringle on Jun. 20, 1995; U.S. Pat. No. 5,447,246 issued to Finke on Sep. 5, 1995; and U.S. Pat. No. 5,449,080 issued to Finke on Sep. 12, 1995.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of filling machines that utilize electronic control devices to control various portions of a filling or bottling process and that may possibly be utilized or possibly adapted for use in at least one possible embodiment of the present application may possibly be found in the following U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

The appended drawings in their entirety, including all dimensions, proportions and/or shapes in at least one embodiment of the invention, are accurate and are hereby included by reference into this specification.

Some examples of control systems which measure operating parameters and learn therefrom that may possibly be utilized or possibly adapted for use in at least one possible embodiment of the present application may possibly be found in the following U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

Some examples of memories that may possibly be utilized or possibly adapted for use in at least one possible embodiment of the present application may possibly be found in the following U.S. Pat. No. 5,789,887 issued to Elischewski on Aug. 4, 1998; U.S. Pat. No. 5,453,736 issued to Noren on Sep. 26, 1995; U.S. Pat. No. 5,315,220 issued to Takimoto et al. on May 24, 1994; U.S. Pat. No. 4,994,724 issued to Hsu on Feb. 19, 1991; U.S. Pat. No. 4,498,033 issued to Aihara et al. on Feb. 5, 1985; and U.S. Pat. No. 4,328,540 issued to Matsuoka et al. on May 4, 1982.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of microprocessors that may possibly be utilized or possibly adapted for use in a possible embodiment of the present application may possibly be found in the following U.S. Pat. No. 5,770,934 issued to Theile on Jun. 23, 1998; U.S. Pat. No. 5,653,056 issued to Stark on Aug. 5, 1997; U.S. Pat. No. 5,647,173, issued to Stark et al. on Jul. 15, 1997; U.S. Pat. No. 5,625,266 issued to Stark on Apr. 29, 1997; U.S. Pat. No. 5,479,151 issued to Lavelle et al. on Dec. 26, 1995; and U.S. Pat. No. 5,453,736 issued to Noren on Sep. 26, 1995.

All, or substantially all, of the components and methods of the various embodiments may be used with at least one embodiment or all of the embodiments, if more than one embodiment is described herein.

Some examples of open-loop control systems that may possibly be utilized or possibly adapted for use in at least one possible embodiment of the present application may possibly be found in the following U.S. Pat. No. 5,770,934 issued to Theile on Jun. 23, 1998; U.S. Pat. No. 5,210,473 issued to Backstrand on May 11, 1993; U.S. Pat. No. 5,320,186 issued to Strosser et al. on Jun. 14, 1994; and U.S. Pat. No. 5,369,342 issued to Rudzewicz et al. on Nov. 29, 1994.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of closed-loop control circuits that may possibly be utilized or possibly adapted for use in at least one possible embodiment of the present application may possibly be found in the following U.S. Pat. No. 5,770,934 issued to Theile on Jun. 23, 1998; U.S. Pat. No. 5,189,605 issued to Zuehlke et al. on Feb. 23, 1993; U.S. Pat. No. 5,223,072 issued to Brockman et al. on Jun. 29, 1993; and U.S. Pat. No. 5,252,901, issued to inventors Ozawa et al. on. Oct. 12, 1993.

All of the patents, patent applications and publications recited herein, and in the Declaration attached hereto, are hereby incorporated by reference as if set forth in their entirety herein.

Some examples of look up tables accessed by computers or microprocessors that may possibly be utilized or possibly adapted for use in at least one possible embodiment of the present application may possibly be found in the following U.S. Pat. No. 5,284,116 issued to Richeson, Jr. on Feb. 8, 1994; U.S. Pat. No. 5,359,325 issued to Ford et al. on Oct. 25, 1994; and U.S. Pat. No. 5,371,537 issued to Bohan et al. on Dec. 6, 1994.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of databuses or databus systems that may possibly be utilized or possibly adapted for use in at least one possible embodiment of the present application may possibly be found in the following U.S. Pat. No. 6,008,546 issued to Sage on Dec. 28, 1999; U.S. Pat. No. 5,978,193 issued to Kaaden on Nov. 2, 1999; U.S. Pat. No. 5,815,732 issued to Cooper et al. on Sep. 29, 1998; U.S. Pat. No. 5,507,001 issued to Nishizawa on Apr. 9, 1996; U.S. Pat. No. 5,402,423 issued to Van Kersen on Mar. 28, 1995; and U.S. Pat. No. 4,725,838 issued to Maschek et al. on Feb. 16, 1998.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of cameras or the like optical monitoring apparatus that may possibly be utilized or possibly adapted for use in at least one possible embodiment of the present application may possibly be found in the following U.S. Pat. No. 5,233,186 issued to Ringlien on Aug. 3, 1993; U.S. Pat. No. 5,243,400 issued to Ringlien on Sep. 7, 1993; U.S. Pat. No. 5,369,713 issued to Schwartz et al. on Nov. 29, 1994; U.S. Pat. No. 5,442,446 issued to Gerber et al. on Aug. 15, 1995; U.S. Pat. No. 5,661,295 issued to Buchmann et al. on Aug. 26, 1997; and U.S. Pat. No. 5,898,169 issued to Nodbryhn on Apr. 27, 1999.

The corresponding foreign patent publication applications, namely, Federal Republic of Germany Patent Application No. DE P 103 06 671, filed on Feb. 18, 2003, having inventor Heinz-Michael ZWILLING, and DE-OS 103 06 671, having inventor Heinz-Michael ZWILLING, and DE-PS 103 06 671, having inventor Heinz-Michael ZWILLING, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of interface arrangements that may possibly be utilized or possibly adapted for use in at least one possible embodiment of the present application may possibly be found in the following U.S. Pat. No. 5,001,704 issued to Narup et al. on Mar. 19, 1991; U.S. Pat. No. 5,961,356 issued to Fekete on Oct. 5, 1999; U.S. Pat. No. 6,621,692 issued to Johnson et al. on Sep. 16, 2003; U.S. Pat. No. 6,661,961 issued to Allen et al. on Dec. 9, 2003; U.S. Pat.

No. 6,687,166 issued to Takahashi et al. on Feb. 3, 2004; and U.S. Pat. No. 6,687,779 issued to Sturm et al. on Feb. 3, 2004.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of rotation sensors that may possibly be utilized or possibly adapted for use in at least one possible embodiment of the present application may possibly be found in the following U.S. Pat. No. 6,246,232 issued to Okamura on Jun. 12, 2001; U.S. Pat. No. 6,448,761 issued to Stumpe on Sep. 10, 2002; U.S. Pat. No. 6,474,162 to Voss et al. on Nov. 5, 2002; U.S. Pat. No. 6,498,481 issued to Apel on Dec. 24, 2002; U.S. Pat. No. 6,532,831 issued to Jin et al. on Mar. 18, 2003; and U.S. Pat. No. 6,672,175 issued to Jin et al. on Jan. 6, 2004.

The details in the patents, patent applications and publications may be considered to be incorporable, at applicant's option, into the claims during prosecution as further limitations in the claims to patentably distinguish any amended claims from any applied prior art.

Some examples of infrared sensor and infrared receiving arrangements that may possibly be utilized or possibly adapted for use in at least one possible embodiment of the present application may possibly be found in the following U.S. Pat. No. 4,533,226 issued to Odone on Aug. 6, 1985; U.S. Pat. No. 5,815,108 issued to Terk on Sep. 29, 1998; U.S. Pat. No. 6,010,399 issued to Lee et al. on Jan. 4, 2000; U.S. Pat. No. 6,262,661 issued to Mahler et al. on Jul. 17, 2001; and U.S. Pat. No. 6,377,174 issued to Siegwart et al. on Apr. 23, 2002.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of light sensors that may possibly be utilized or possibly adapted for use in at least one possible embodiment of the present application may possibly be found in the following U.S. Pat. No. 4,899,041 issued to Fetter et al. on Feb. 6, 1990; U.S. Pat. No. 5,225,689 issued to Bückle et al. on Jul. 6, 1993; U.S. Pat. No. 5,365,059 issued to Savage on Nov. 15, 1994; U.S. Pat. No. 5,736,733 issued to Shima et al. on Apr. 7, 1998; U.S. Pat. No. 6,493,567 issued to Krivitski et al. on Dec. 10, 2002; and U.S. Pat. No. 6,566,672 issued to Schlough et al. on May 20, 2003.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

Some examples of servo-motors that may possibly be utilized or possibly adapted for use in at least one possible embodiment of the present application may possibly be found in the following U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

Some examples of laser printing arrangements that may possibly be utilized or possibly adapted for use in at least one possible embodiment of the present application may possibly be found in the following U.S. Pat. No. 4,847,643 issued to Ohmori on Jul. 11, 1989; U.S. Pat. No. 5,294,945 issued to Omura et al. on Mar. 15, 1994; U.S. Pat. No. 5,528,280 issued to Endo et al. on Jun. 18, 1996; U.S. Pat. No. 6,210,778 issued to Poirier et al. on Apr. 3, 2001; U.S. Pat. No. 6,433,810 issued to Katayama et al. on Aug. 13, 2002; and U.S. Pat. No. 6,655,275 issued to Mugrauer on Dec. 2, 2003.

Some examples of laser marking that may possibly be utilized or possibly adapted for use in at least one possible embodiment of the present application may possibly be found in the following U.S. Pat. No. 6,429,889 issued to Murokh on Aug. 6, 2002; U.S. Pat. No. 6,483,073 issued to Tenderly on Nov. 19, 2002; U.S. Pat. No. 6,489,985 issued to Brodsky et al. on Dec. 3, 2002; U.S. Pat. No. 6,613,161 issued to Zheng et al. on Sep. 2, 2003; U.S. Pat. No. 6,627,299 issued to Feng et al. on Sep. 30, 2003; and U.S. Pat. No. 6,683,637 issued to Corbett on Jan. 27, 2004.

Some examples of ink jet printing apparatus and methods that may possibly be utilized or possibly adapted for use in at least one possible embodiment of the present application may possibly be found in the following U.S. Pat. No. 6,582,047 issued to Koitabashi et al. on Jun. 24, 2003; U.S. Pat. No. 6,623,093 issued to Takahashi et al. on Sep. 23, 2003; U.S. Pat. No. 6,625,351 issued to Cox et al. on Sep. 23, 2003; U.S. Pat. No. 6,652,055 issued to Oikawa on Nov.

25, 2003; U.S. Pat. No. 6,669,767 issued to Blease et al. on Dec. 30, 2003; and U.S. Pat. No. 6,688,739 issued to Murray on Feb. 10, 2004.

Some examples of screen printing apparatus that may possibly be utilized or possibly adapted for use in at least one possible embodiment of the present application may possibly be found in the following U.S. Pat. No. 5,374,449 issued to Bühlmann et al. on Dec. 20, 1994; U.S. Pat. No. 5,722,321 issued to Szyszko et al. on Mar. 3, 1998; U.S. Pat. No. 6,591,745 issued to Miyahara et al. on Jul. 15, 2003; U.S. Pat. No. 6,601,502 issued to Kamen et al. on Aug. 5, 2003; U.S. Pat. No. 6,619,197 issued to Murakami et al. on Sep. 16, 2003; and U.S. Pat. No. 6,659,005 issued to Takahashi et al. on Dec. 9, 2003.

Some examples of tampon printing apparatus that may possibly be utilized or possibly adapted for use in at least one possible embodiment of the present application may possibly be found in the following U.S. Pat. No. 4,723,485 issued to Berberich et al. on Feb. 9, 1988; U.S. Pat. No. 5,003,872 issued to Dalferth on Apr. 2, 1991; No. 5,383,398 issued to Binned on Jan. 24, 1995; U.S. Pat. No. 5,222,433 issued to Philipp on Jun. 29, 1993; U.S. Pat. No. 5,802,972 issued to Hoffmann et al. on Sep. 8, 1998; and U.S. Pat. No. 6,619,203 issued to Philipp on Sep. 16, 2003.

Some examples of connecting arrangements that may possibly be utilized or possibly adapted for use in at least one possible embodiment may possibly be found in the following U.S. Pat. No. 4,648,630 issued to Bruch on Mar. 10, 1987; U.S. Pat. No. 5,964,483 issued to Long et al. on Oct. 12, 1999; U.S. Pat. No. 6,299,215 issued to Kirby on Oct. 9, 2001; U.S. Pat. No. 6,318,410 issued to Miyajima et al. on Nov. 20, 2001; U.S. Pat. No. 6,644,884 issued to Gledhill on Nov. 11, 2003; and U.S. Pat. No. 6,675,833 issued to Maldavs on Jan. 13, 2004.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiment of the application.

The sentence immediately above relates to patents, published patent applications and other documents either incorporated by reference or not incorporated by reference.

Thus, in one aspect of the application there is proposed a labeling machine, particularly for containers and the like, comprising a machine frame structure with a drive for a turntable that is equipped with support tables for the items that are to be labeled, as well as processing stations connected to the sub-structure of the machine frame structure, such as, for example, labeling stations, there being provided that next to the labeling stations are disposed at least one inspecting module and/or a printing module and/or an alignment module, and that this module is configured as a replaceable unit.

Some examples of quick release devices or structures, or related devices or structures, that may possibly be utilized or possibly adapted for use in at least one possible embodiment may possibly be found in the following patents, patent publications, and other references: U.S. Pat. No. 1,835,251, issued December, 1931 Wetstein; U.S. Pat. No. 1,899,360, issued February, 1933 to Roudebush et al; U.S. Pat. No. 2,384,267, issued September, 1945 to Andersen; U.S. Pat. No. 2,872,139, issued October, 1953 to Bedford, Jr; U.S. Pat. No. 2,714,195, issued July, 1955 to Beatty; U.S. Pat. No. 2,760,174, issued August, 1956 to Burtt et al; U.S. Pat. No. 2,737,008, issued October, 1956 to Oswald; U.S. Pat. No. 2,881,404, issued April, 1959 to Kamm; U.S. Pat. No. 2,899,669, issued August, 1959 to Johanson; U.S. Pat. No. 3,017,232, issued January, 1962 to Schwab et al; U.S. Pat. No. 3,035,243, issued May, 1962 to Bowling; U.S. Pat. No. 3,311,863, issued March, 1967 to Beale; U.S. Pat. No. 3,398,390, issued August, 1968 to Long; U.S. Pat. No. 3,408,614, issued October, 1968 to Kuwahata; U.S. Pat. No. 3,451,034, issued June, 1969 to Beale; U.S. Pat. No. 3,476,258, issued November, 1969 to Dorsett; U.S. Pat. No. 3,495,206, issued February, 1970 to Pfister; U.S. Pat. No. 3,518,612, issued June, 1970 to Dunman et al; U.S. Pat. No. 3,566,190, issued February, 1971 to Huebner et al; U.S. Pat. No. 3,566,336, issued February, 1971 to Johnson et al; U.S. Pat. No. 3,576,515, issued April, 1971 to Frantz; U.S. Pat. No. 3,594,698, issued July, 1971 to Anhalt; U.S. Pat. No. 3,668,605, issued June, 1972 to Albert; U.S. Pat. No. 3,736,471, issued May, 1973 to Donze et al; U.S. Pat. No. 3,767,974, issued October, 1973 to Donovan, Jr. et al; U.S. Pat. No. 3,784,954, issued January, 1974 to Grimm et al; U.S. Pat. No. 3,798,507, issued March, 1974 to Damon et al; U.S. Pat. No. 3,803,409, issued April, 1974 to Prochazka; U.S. Pat. No. 3,806,225, issued April, 1974 to Codrino; U.S. Pat. No. 3,809,908, issued May, 1974 to Clanton; U.S. Pat. No. 3,915,538, issued October, 1975 to Gruhn, Jr. et al; U.S. Pat. No. 3,950,059, issued April, 1976 to Anhalt et al; U.S. Pat. No. 3,951,514, issued April, 1976 to Medina, Jr; U.S. Pat. No. 3,952,232, issued April, 1976 to Coules; U.S. Pat. No. 4,045,109, issued August, 1977 to Langenbach et al; U.S. Pat. No. 4,064,551, issued December, 1977 to Lightfoot; U.S. Pat. No. 4,070,081, issued January, 1978 to Takahashi; U.S. Pat. No. 4,083,616, issued April, 1978 to McNiece et al; U.S. Pat. No. 4,084,882, issued April, 1978 to Hogan et al; U.S. Pat. No. 4,140,367, issued February, 1979 to Makuch et al; U.S. Pat. No. 4,149,072, issued April, 1979 to Smith et al; U.S. Pat. No. 4,152,038, issued May, 1979 to Inouye et al; U.S. Pat. No. 4,167,303, issued September, 1979 to Bowen et al; U.S. Pat. No. 4,197,572, issued April, 1980 to Aimar; U.S. Pat. No. 4,217,030, issued August, 1980 to Howarth; U.S. Pat. No. 4,226,491, issued October, 1980 to Kazama et al; U.S. Pat. No. 4,233,646, issued November, 1980 to Leung et al; U.S. Pat. No. 4,243,283, issued January, 1981 to McSparran; U.S. Pat. No. 4,260,210, issued April, 1981 to Babuka et al.; U.S. Pat. No. 4,268,114, issued May, 1981 to dAuria et al; U.S. Pat. No. 4,273,413, issued June, 1981 to Bendiksen et al; U.S. Pat. No. 4,295,181, issued October, 1981 to Chang et al; U.S. Pat. No. 4,301,494, issued Novomber, 1981 to Jordan; U.S. Pat. No. 4,313,150, issued January, 1982 to Chu; U.S. Pat. No. 4,377,318, issued March, 1983 to Long; U.S. Pat. No. 4,384,368, issued May, 1983 to Rosenfeldt et al; U.S. Pat. No. 4,387,956, issued June, 1983 to Cline; U.S. Pat. No. 4,398,073, issued August, 1983 to Botz et al; U.S. Pat. No. 4,406,514, issued September, 1983 to Hillegonds et al; U.S. Pat. No. 4,410,222, issued October, 1983 to Enomoto et. al; U.S. Pat. No. 4,427,879, issued January, 1984 to Becher et al; U.S. Pat. No. 4,432,604, issued February, 1984 to Schwab; U.S. Pat. No. 4,439,006, issued March, 1984 to Stevenson; U.S. Pat. No. 4,445,740, issued May, 1984 to Wallace; U.S. Pat. No. 4,448,467, issued May, 1984 to Weidler; U.S. Pat. No. 4,449,784, issued May, 1984 to Basov et al; U.S. Pat. No. 4,460,230, issued July, 1984 to McKee et al; U.S. Pat. No. 4,470,660, issued September, 1984 to Hillegonds et al; U.S. Pat. No. 4,477,133, issued October, 1984 to Cosmo; U.S. Pat. No. 4,477,146, issued October, 1984 to Bowen et al; U.S. Pat. No. 4,491,981, issued January, 1985 to Weller et al; U.S. Pat. No. 4,522,463, issued June, 1985 to Schwenda et al; U.S. Pat. No. 4,526, 427, issued July, 1985 to Boll et al; U.S. Pat. No. 4,527,285, issued July, 1985 to Kekas et al; U.S. Pat. No. 4,541,036, issued September, 1985 to Landries et al; U.S. Pat. No. 4,548,467, issued October, 1985 to Stoerk et al; U.S. Pat. No. 4,553,813, issued November, 1985 to McNaughton et al; U.S. Pat. No. 4,553,814, issued November, 1985 to Bahl et al; U.S. Pat. No. 4,611,887, issued September, 1986 to Glover et al; U.S. Pat. No. 4,619,493, issued October, 1986 to Kikuta; U.S. Pat. No. 4,678,264, issued July, 1987 to Bowen et al; U.S. Pat. No. 4,684,210, issued August, 1987 to Matsunaga et al; U.S. Pat. No. 4,699,438, issued October, 1987 to Kikuta; U.S. Pat. No. 4,699,455, issued October, 1987 to Erbe et al; U.S. Pat. No. 4,737,008, issued April, 1988 to Ohyama et al; U.S. Pat. No. 4,756,593, issued July, 1988 to Koakutsu et al; U.S. Pat. No. 4,762,388, issued August, 1988 to Tanaka et al; U.S. Pat. No. 4,767,179, issued August, 1988 to Sampson et al; U.S. Pat. No. 4,787,706, issued November, 1988 to Cannon, Jr. et al; U.S. Pat. No. 4,789,218, issued December, 1988 to Paul et al; U.S. Pat. No. 4,798,430, issued January, 1989 to Johnson et al; U.S. Pat. No. 4,798,440, issued January, 1989 to Hoffer et al; U.S. Pat. No. 4,821,145, issued April, 1989 to Corfits et al; U.S. Pat. No. 4,838,810, issued June, 1989 to Yoshimura et al; U.S. Pat. No. 4,840,451, issued June, 1989 to Sampson et al; U.S. Pat. No. 4,861,134, issued August, 1989 to Alameel et al; U.S. Pat. No. 4,872,736, issued October, 1989 to Myers et al; U.S. Pat. No. 4,900,263, issued February, 1990 to Manassero et al; U.S. Pat. No. 4,906,197, issued March, 1990 to Noll; U.S. Pat. No. 4,944,568, issued July, 1990 to Danbach et al; U.S. Pat. No. 4,960,317, issued October, 1990 to Briggs et al; U.S. Pat. No. 4,969,924, issued November, 1990 to Suverison et al; U.S. Pat. No. 4,986,625, issued January, 1991 to Yamada et al; U.S. Pat. No. 4,991,062, issued February, 1991 to Nguyenngoc; U.S. Pat. No. 4,995,821, issued February, 1991 to Casey; U.S. Pat. No. 4,997,386, issued March, 1991 to Kawachi et al; U.S. Pat. No. 5,005,939, issued April, 1991 to Arvanitakis et al; U.S. Pat. No. 5,011,425, issued April, 1991 to Van Zanten et al; U.S. Pat. No. 5,013,247, issued May, 1991 to Watson; U.S. Pat. No. 5,016,968, issued May, 1991 to Hammond et al; U.S. Pat. No. 5,021,003, issued June, 1991 to Ohtaka et al; U.S. Pat. No. 5,039,194, issued August, 1991 to Block et al; U.S. Pat. No. 5,042,891, issued August, 1991 to Mulholland et al; U.S. Pat. No. 5,044,982, issued September, 1991 to Bertini; U.S. Pat. No. 5,062,806, issued November, 1991 to Ohno et al; U.S. Pat. No. 5,067,785, issued November, 1991 to Schirbl et al; U.S. Pat. No. 5,071,219, issued December, 1991 to Yurtin et al; U.S. Pat. No. 5,073,045, issued December, 1991 to Abendschein; U.S. Pat. No. 5,073,046, issued December, 1991 to Edwards et al; U.S. Pat. No. 5,076,656, issued December, 1991 to Briggs et al; U.S. Pat. No. 5,082,344, issued January, 1992 to Mulholland et al; U.S. Pat. No. 5,083,931, issued January, 1992 to Davidge et al; U.S. Pat. No. 5,084,802, issued January, 1992 to Nguyenngoc; U.S. Pat. No. 5,091,991, issued February, 1992 to Briggs et al; U.S. Pat. No. 5,099,307, issued March, 1992 to Go et al; U.S. Pat. No. 5,101,463, issued March, 1992 to Cubukciyan et al; U.S. Pat. No. 5,104,243, issued April, 1992 to Harding; U.S. Pat. No. 5,109,453, issued Aprril, 1992 to Edwards et al; U.S. Pat. No. 5,113,467, issued May, 1992 to Peterson et al; U.S. Pat. No. 5,116,239, issued May, 1992 to Siwinski; U.S. Pat. No. 5,117,476, issued May, 1992 to Yingst et al; U.S. Pat. No. 5,118,904, issued June, 1992 to Nguyenngoc; U.S. Pat. No. 5,125,849, issued June, 1992 to Briggs et al; U.S. Pat. No. 5,134,679, issued July, 1992 to Robin et al; U.S. Pat. No. 5,138,678, issued August, 1992 to Briggs et al; U.S. Pat. No. 5,140,663, issued August, 1992 to Edwards et al; U.S. Pat. No. 5,142,597, issued August, 1992 to Mulholland et al; U.S. Pat. No. 5,155,786, issued October, 1992 to Ecker et al; U.S. Pat. No. 5,159,652, issued October, 1992 to D'Alphonse et al.; U.S. Pat. No. 5,163,109, issued November, 1992 to Okugawa et al; U.S. Pat. No. 5,163,847, issued November, 1992 to Regnier; U.S. Pat. No. 5,183,404, issued February, 1993 to Aldous et al; U.S. Pat. No. 5,195,911, issued March, 1993 to Murphy; U.S. Pat. No. 5,199,093, issued March, 1993 to Longhurst; U.S. Pat. No. 5,204,929, issued April, 1993 to Machall et al; U.S. Pat. No. 5,212,681, issued May, 1993 to Bock et al; U.S. Pat. No. 5,212,761, issued May, 1993 to Petrunia; U.S. Pat. No. 5,218,519, issued June, 1993 to Welch et al; U.S. Pat. No. 5,234,353, issued August, 1993 to Scholz et al; U.S. Pat. No. 5,238,426, issued August, 1993 to Arnett; U.S. Pat. No. 5,243,678, issued September, 1993 to Schaffer et al; U.S. Pat. No. 5,247,427, issued September, 1993 to Driscoll et al; U.S. Pat. No. 5,253,320, issued October, 1993 to Takahashi et al; U.S. Pat. No. 5,259,052, issued November, 1993 to Briggs et al; U.S. Pat. No. 5,262,923, issued November, 1993 to Batta et al; U.S. Pat. No. 5,274,729, issued December, 1993 to King et al; U.S. Pat. No. 5,283,680, issued February, 1994 to Okugawa et al; U.S. Pat. No. 5,286,207, issued February, 1994 to McHugh; U.S. Pat. No. 5,289,345, issued February, 1994 to Corradetti et al; U.S. Pat. No. 5,295,212, issued March, 1994 to Morton et al; U.S. Pat. No. 5,315,679, issued May, 1994 to Baldwin et al; U.S. Pat. No. 5,317,663, issued May, 1994 to Beard et al; U.S. Pat. No. 5,325,454, issued June, 1994 to Rittle et al; U.S. Pat. No. 5,325,455, issued June, 1994 to Henson et al; U.S. Pat. No. 5,329,428, issued July, 1994 to Block et al; U.S. Pat. No. 5,329,604, issued July, 1994 to Baldwin et al; U.S. Pat. No. 5,333,221, issued July, 1994 to Briggs et al; U.S. Pat. No. 5,337,396, issued August, 1994 to Chen et al; U.S. Pat. No. 5,361,318, issued November, 1994 to Go et al.; U.S. Pat. No. 5,363,465, issued November, 1994 to Korkowski et al; U.S. Pat. No. D353,796, issued December, 1994 to Oliver et al; U.S. Pat. No. D354,271, issued January, 1995 to Speiser et al; U.S. Pat. No. 5,383,793, issued January, 1995 to Hsu et al; U.S. Pat. No. 5,386,346, issued January, 1995 to Gleadall; U.S. Pat. No. 5,390,268, issued February, 1995 to Morlion et al; U.S. Pat. No. 5,398,295, issued March, 1995 to Chang et al; U.S. Pat. No. 5,411,402, issued May, 1995 to Bethurum; U.S. Pat. No. 5,412,497, issued May, 1995 to Kaetsu et al; U.S. Pat. No. 5,425,646, issued June, 1995 to Green; U.S. Pat. No. 5,442,726, issued August, 1995 to Howard et al; U.S. Pat. No. 5,452,388, issued September, 1995 to Rittle et al; U.S. Pat. No. 5,463,532, issued October, 1995 to Petitpierre et al; U.S. Pat. No. 5,469,526, issued November, 1995 to Rawlings; U.S. Pat. No. 5,470,238, issued November, 1995 to Walden; U.S. Pat. No. 5,481,634, issued January, 1996 to Anderson et al; U.S. Pat. No. 5,487,678, issued January, 1996 to Tsuji et al; U.S. Pat. No. 5,491,613, issued February, 1996 to Petitpierre; U.S. Pat. No. 5,515,468, issued May, 1996 to DeAndrea et al; U.S. Pat. No. 5,528,408, issued June, 1996 to McGinley et al; U.S. Pat. No. 5,546,281, issued August, 1996 to Poplawski et al; U.S. Pat. No. 5,548,677, issued August, 1996 to Kakii et al; U.S. Pat. No. 5,561,727, issued October, 1996 to Akita et al; U.S. Pat. No. 5,583,745, issued December, 1996 to Uwabo et al; U.S. Pat. No. 5,596,663, issued January, 1997 to Ishibashi et al; U.S. Pat. No. 5,600,470, issued February, 1997 to Walsh; U.S. Pat. No. 5,604,831, issued February, 1997 to Dittman et al; U.S. Pat. No. 5,654,873, issued August, 1997 to Smithson et al; U.S. Pat. No. 5,659,459, issued August, 1997 to Wakabayashi et al; U.S. Pat. No. D389,802, issued January, 1998 to Vernon;

U.S. Pat. No. 5,717,533, issued February, 1998 to Poplawski et al; U.S. Pat. No. 5,734,558, issued March, 1998 to Poplawski et al; U.S. Pat. No. 5,738,538, issued April, 1998 to Bruch et al; U.S. Pat. No. 5,757,998, issued May, 1998 to Thatcher et al; U.S. Pat. No. 5,766,027, issued June, 1998 to Fogg; U.S. Pat. No. 5,767,999, issued June, 1998 to Kayner; U.S. Pat. No. 5,797,771, issued August, 1998 to Garside; U.S. Pat. No. 5,864,468, issued January, 1999 to Poplawski et al; U.S. Pat. No. 5,865,646, issued February, 1999 to Ortega et al; U.S. Pat. No. 5,879,173, issued March, 1999 to Poplawski et al; U.S. Pat. No. 5,896,480, issued April, 1999 to Scharf et al; U.S. Pat. No. 5,901,263, issued May, 1999 to Gaio et al.; U.S. Pat. No. 5,966,487, issued October, 1999 to Gilliland et al; U.S. Pat. No. 5,980,324, issued November, 1999 to Berg et al; U.S. Pat. No. 6,047,172, issued April, 2000 to Babineau et al; U.S. Pat. No. 6,052,278, issued April, 2000 to Tanzer et al; U.S. Pat. No. 6,062,893, issued May, 2000 to Miskin et al; U.S. Pat. No. 6,074,228, issued June, 2000 to Berg et al; U.S. Pat. No. 6,085,006, issued July, 2000 to Gaio et al; U.S. Pat. No. RE36820, issued August, 2000 to McGinley et al; U.S. Pat. No. 6,101,087, issued August, 2000 to Sutton et al; U.S. Pat. No. 6,142,802, issued November, 2000 to Berg et al; U.S. Pat. No. 6,149,465, issued November, 2000 to Berg et al; U.S. Pat. No. 6,178,096, issued January, 2001 to Flickinger et al; U.S. Pat. No. 6,179,627, issued January, 2001 to Daly et al; U.S. Pat. No. 6,200,041, issued March, 2001 to Gaio et al; U.S. Pat. No. 6,201,704, issued March, 2001 to Poplawski et al; U.S. Pat. No. 6,203,333, issued March, 2001 to Medina et al; U.S. Pat. No. 6,206,582, issued March, 2001 to Gilliland; U.S. Pat. No. 6,220,873, issued April, 2001 to Samela et al; U.S. Pat. No. 6,220,878, issued April, 2001 to Poplawski et al; U.S. Pat. No. 6,226,188, issued May, 2001 to Warren; U.S. Pat. No. 6,241,534, issued June, 2001 to Neer et al; U.S. Pat. No. 6,267,606, issued July, 2001 to Poplawski et al; U.S. Pat. No. D446,501, issued August, 2001 to Donnell et al; U.S. Pat. No. 6,304,436, issued October, 2001 to Branch et al; U.S. Pat. No. 6,317,329, issued November, 2001 to Dowdy et al; U.S. Pat. No. 6,335,869, issued January, 2002 to Branch et al; U.S. Pat. No. 6,341,899, issued January, 2002 to Shirakawa et al; U.S. Pat. No. 6,350,063, issued February, 2002 to Gilliland et al; U.S. Pat. No. 6,358,082, issued March, 2002 to Letourneau; U.S. Pat. No. 6,364,709, issued April, 2002 to Jones; U.S. Pat. No. 6,369,924, issued April, 2002 to Scharf et al; U.S. Pat. No. 6,371,787, issued April, 2002 to Branch et al; U.S. Pat. No. 6,416,361, issued July, 2002 to Hwang; U.S. Pat. No. 6,431,901, issued August, 2002 to Yeh; U.S. Pat. No. 6,431,902, issued August, 2002 to Yeh; U.S. Pat. No. 6,439,918, issued August, 2002 to Togami et al; U.S. Pat. No. 6,485,322, issued November, 2002 to Branch et al; U.S. Pat. No. 6,692,159, issued February, 2004 to Chiu et al; U.S. Pat. No. 227,252, issued April, 1880 to Hodges; U.S. Pat. No. 1,489,933, issued April, 1924 to Duffy; U.S. Pat. No. 2,249,230, issued July, 1941 to Schafer; U.S. Pat. No. 2,819,784, issued January, 1958 to Brown, Jr.; U.S. Pat. No. 2,968,872, issued January, 1961 to Welles; U.S. Pat. No. 3,175,820, issued March, 1965 to Schiler; U.S. Pat. No. 3,540,318, issued November, 1970 to Greenberg; U.S. Pat. No. 3,793,738, issued February, 1974 to Blakey; U.S. Pat. No. 4,185,812, issued January, 1980 to Hall; U.S. Pat. No. 4,239,445, issued December, 1980 to Ozawa; U.S. Pat. No. 4,331,229, issued May, 1982 to Kamm; U.S. Pat. No. 214,271, issued April, 1879 to Zundorff; U.S. Pat. No. 3,147,404, issued September, 1964 to Sinner; U.S. Pat. No. 3,188,524, issued June, 1965 to Williams; U.S. Pat. No. 3,204,913, issued September, 1965 to Lawrence et al.; U.S. Pat. No. 3,378,320, issued April, 1968 to Morgan et al.; U.S. Pat. No. 3,675,084, issued July, 1972 to Jammaud; U.S. Pat. No. 3,679,829, issued July, 1972 to Hofineister et al.; U.S. Pat. No. 3,683,238, issued August, 1972 to Olds et al.; U.S. Pat. No. 3,689,128, issued September, 1972 to Andreni et al.; U.S. Pat. No. 4,002,955, issued January, 1977 to Eggert et al.; U.S. Pat. No. 4,316,236, issued February, 1982 to Lechner et al.; U.S. Pat. No. 4,699,270, issued October, 1987 to Bohm; U.S. Pat. No. 4,728,160, issued March, 1988 to Mondor et al.; U.S. Pat. No. 4,758,923, issued July, 1988 to Tanaka et al.; U.S. Pat. No. 4,758,924, issued July, 1988 to Dillon et al.; U.S. Pat. No. 4,805,906, issued February, 1989 to Wiczer et al.; U.S. Pat. No. 4,985,804, issued January, 1991 to Campbell et al.; U.S. Pat. No. 5,001,602, issued March, 1991 to Suffi et al.; U.S. Pat. No. 5,097,386, issued March, 1992 to Byell et al.; GB 2 297 007, published July, 1996; JP 07-225327, published August, 1995; WO 95/12227, published May; GB 1238521, published July, 1971; DE1230475, published December, 1966; Nagesh R. Basavanhally et al., "Optoelectronic Packaging," Chapter 2, Communication System Interconnection Structure, pp. 11–23, 38–43, John Wiley & Sons, Inc. New York; and Shinichi Sasaki et al., "A Compact Optical Active Connector: An Optical Interconnect Module with an Electrical Connector Interface," IEEE Transactions on Advanced Packaging, vol. 22, No. 4, November 1999.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A beverage bottling plant for filling bottles with a liquid beverage filling material, said beverage bottling plant comprising:

a filling machine being configured to fill empty bottles with liquid beverage filling material;

a conveyer arrangement being configured and disposed to move empty bottles to said filling machine;

said beverage filling machine comprising a plurality of beverage filling positions, each beverage filling position comprising a beverage filling device for filling bottles with liquid beverage filling material;

said filling devices comprising an apparatus being configured to introduce a predetermined volume of liquid beverage filling material into the interior of bottles to a substantially predetermined level of liquid beverage filling material;

said apparatus being configured to introduce a predetermined volume of liquid beverage filling material comprising an apparatus being configured to terminate the filling of beverage bottles upon liquid beverage filling material reaching said substantially predetermined level in bottles;

a closing station being configured and disposed to close filled bottles;

a conveyer arrangement being configured and disposed to transfer filled bottles from said filling machine to said closing station;

a labeling station being configured and disposed to receive bottles to be labeled;

a conveyer arrangement being configured and disposed to convey bottles to said labeling station;

said labeling station comprising:

a frame structure, said frame structure having an axis disposed vertically;

a turntable structure being configured and disposed to rotate about said vertical axis of said frame structure, said turntable structure having a peripheral region;

a drive arrangement being configured and disposed to rotate said turntable structure about said vertical axis of said frame structure;

a plurality of support tables being configured to support and to rotate a bottle;

said support tables being disposed at said peripheral region of said turntable structure;

each support table having an axis disposed vertically about which vertical axis a support table can rotate;

each support table comprising a drive arrangement being configured and disposed to rotate its corresponding support table about its vertical support table axis, to permit rotation of a bottle supported on a support table;

a plurality of modules comprising:

a first module comprising:

at least one camera being configured and disposed to produce an image representative of the actual rotational position of a bottle supported on its corresponding support table adjacent said first module and to output signals representative of the image representative of the actual rotational position of a bottle;

a computer being configured and disposed to receive from said camera the output signals representative of the actual rotational position of a bottle, to compare the image representative of the actual rotational position with an image representative of a preset rotational position, and to output signals, to the drive arrangement of an adjacent support table, to energize the drive arrangement and thus to rotate to a first position said adjacent support table and a supported bottle;

a second module comprising:

at least one camera being configured and disposed to produce an image representative of the actual rotational position of a bottle supported on its corresponding support table adjacent said second module and to output signals representative of the image representative of the actual rotational position of a bottle;

a computer being configured and disposed to receive from said camera of said second module the output signals representative of the actual rotational position of a bottle, to compare the image representative of the actual rotational position with an image representative of a preset rotational position, and to output signals, to the drive arrangement of said support table adjacent said second module, to energize the drive arrangement and thus to rotate to a second position said support table adjacent said second module and a supported bottle;

said second position being of greater precision than said first position;

a third module being configured and disposed to affix a label to a bottle disposed in said second position on a support table adjacent said third module;

a fourth module being configured and disposed to print information on the label affixed to a bottle by said third, labeling, module; and a fifth module being configured and disposed to inspect for the presence of a label on a bottle, and to determine the position of a label on a bottle;

each of said modules comprising a first coupling structure;

a plurality of second coupling structures, each being connected to said frame structure;

each first coupling structure being configured to be connectable to and to be disconnectable from its corresponding second coupling structure; and each module being configured, upon connection to a second coupling structure, to be disposed adjacent moving bottles supported on said support tables.

2. The beverage bottling plant according to claim 1, wherein:

said first coupling structure and a second coupling structure together comprise a quick-connect and quick-disconnect structure;

each first coupling structure of each module is configured to be interchangeably connected to a plurality of second coupling structures;

said third, labeling, module, said fourth, printing, module, said fifth, inspecting, module each comprise a computer configured to process signals;

each one of said plurality of modules comprises a bus system configured and disposed to transfer signals from and to a corresponding module;

at least one of said modules comprises an arrangement to generate light;

at least one of: said first, alignment, module, said second, alignment, module, and said fifth, inspecting, module comprises at least one of: (i) and (ii), wherein (i) and (ii) comprise:

(i) a plurality of sensors configured and disposed to sense the presence a label affixed to a bottle; and (ii) a plurality of sensors configured to sense the position of a label affixed to a bottle;

one of: (ii) and (iii), wherein (ii) and (iii) comprise:

(i) at least one of: said first, alignment, module, said second, alignment, module, and said fifth, inspecting, module is configured to sense a deviation of the actual position of a label affixed to a bottle by said third, labeling, module from a desired position of a label which label is to be added on a bottle; and (ii) at least one of: said first, alignment, module, said second alignment, module, and said fifth, inspecting, module is configured to output signals to said third, labeling, module to minimize deviation of the actual position of a label affixed on a bottle by said third, labeling, module from the desired position of a label affixed on a bottle; and said fifth, inspecting, module is configured to issue signals to said third, labeling, module to discontinue operation of said third, labeling, module.

3. The beverage bottling plant according to claim 2, comprising:

a conveyer arrangement configured and disposed to remove bottles comprising a defective label from said labeling station; and said fifth, inspecting, module is configured to output signals to permit removal of bottles comprising a defective label with said removing conveyer arrangement from said labeling station;

at least one of: (i) and (ii), wherein (i) and (ii) comprise:

(i) at least one of: said first, alignment, module and said second, alignment, module comprises a plurality of sensors each being configured and disposed to sense the degree of rotation of a container disposed on a support table;

(ii) a central control is operatively connected to said labeling station; and one of: (a) and (b), wherein (a) and (b) comprise:

(a) one of: said first, alignment, module and said second, alignment, module is configured to correct, under instructions from said central control, the degree of rotation of a support table and a bottle supported thereon; and (b) one of: said first, alignment, module and said second, alignment, module is configured to correct, under absence of instructions from said central control, the degree of rotation of a support table and a bottle supported thereon;

said fourth, printing, module comprises an arrangement comprising one of: laser printing apparatus; laser marking apparatus; ink jet printing apparatus; tampon printing apparatus; and screen printing apparatus.

* * * * *